US005632170A

United States Patent [19]

Evans

[11] Patent Number: 5,632,170

[45] Date of Patent: May 27, 1997

[54] COMBINATION LOCK PREVENTING MANIPULATION FOR UNAUTHORIZED ACCESS

[75] Inventor: Walter R. Evans, King, N.C.

[73] Assignee: Ilco Unican Corporation, Winston-Salem, N.C.

[21] Appl. No.: 575,593

[22] Filed: Dec. 20, 1995

[51] Int. Cl.[6] ..... E05B 37/08

[52] U.S. Cl. ..... 70/303 A; 70/333 R; 70/322

[58] Field of Search ..... 70/303 A, 303 R, 70/333 R, 301, 302, 315–318, 321, 322

[56] References Cited

U.S. PATENT DOCUMENTS

| | | | |
|---|---|---|---|
| 2,594,559 | 4/1952 | Hopkins | 70/242 |
| 2,775,113 | 12/1956 | Behrens | 70/133 |
| 2,807,954 | 10/1957 | Miller | 70/333 |
| 3,045,466 | 7/1962 | Herlong | 70/303 |
| 3,339,383 | 9/1967 | Miller et al. | 70/333 |
| 3,413,828 | 12/1968 | Harrell | 70/303 R X |
| 3,906,761 | 9/1975 | Swaim | 70/333 R |
| 3,968,667 | 7/1976 | Gartner et al. | 70/303 A |
| 3,991,596 | 11/1976 | Gartner | 70/303 A |
| 4,512,167 | 4/1985 | Remenicky | 70/443 |
| 4,532,785 | 8/1985 | Uyeda | 70/333 R |
| 4,628,715 | 12/1986 | Uyeda et al. | 70/333 R |
| 4,756,176 | 7/1988 | Uyeda | 70/303 A |
| 4,831,851 | 5/1989 | Larson | 70/303 A |
| 4,901,546 | 2/1990 | Uyeda et al. | 70/333 R X |
| 4,910,981 | 3/1990 | Gartner | 70/314 |
| 5,473,920 | 12/1995 | Goldman | 70/303 A |

FOREIGN PATENT DOCUMENTS

| | | | |
|---|---|---|---|
| 705729 | 3/1954 | United Kingdom | 70/303 A |
| 735148 | 8/1955 | United Kingdom | 70/303 A |
| 2241983 | 9/1991 | United Kingdom | 70/321 |

*Primary Examiner*—Suzanne Dino
*Attorney, Agent, or Firm*—Hill, Steadman & Simpson

[57] ABSTRACT

An improved combination lock, such as for a safe, for the lock type having a plurality of tumbler wheels mounted coaxially with a driving cam, the tumbler wheels having fence gates to be aligned by proper combination dialing, the driving cam having a cam gate for reception of a fence nose on a fence lever when the combination is dialed, the fence lever normally biased to hold the fence and the fence lever nose in an elevated position with respect to the cam and the tumbler wheels but having an override spring which during an arc portion of each full revolution of the dial biases the fence lever in a downward engaging position against the tumbler wheels and which will engage the fence nose with the cam gate if the correct combination is dialed. A J-shaped wire spring is provided extending between the pivot point of the cam lever attachment to the latch and extending around the cam and engageable by an orbital roller mounted on the cam surface to initiate the reverse, downward bias of the cam lever once per revolution.

21 Claims, 3 Drawing Sheets

COMBINATION LOCK PREVENTING MANIPULATION FOR UNAUTHORIZED ACCESS

BACKGROUND OF THE INVENTION

In prior known combination locks, there is provided a cam concentrically arranged with tumbler wheels.

The tumbler wheels are journaled in coaxial relation for rotation within a lock casing on a tubular arbor or tumbler post projecting inwardly from the front wall of the casing. The lock dial, which usually has 100 peripheral calibration marks thereon, is affixed to a dial spindle which extends through the bore of the tumbler post and has keyed to the inner end thereof a disk-like drive cam which is likewise arranged coaxially with and spaced rearwardly from the tumbler wheels. A drive pin projects forwardly from the drive cam and has a lost motion connection through a conventional fly with the rearmost tumbler wheel to drive the tumbler wheel in selected relation to the drive cam. A similar lost motion connection is provided between each of the successive tumbler wheels so that each of the tumbler wheels may be driven upon predetermined rotation of the drive cam. The drive cam and tumbler wheels are rotatable by mechanical engagement with the lock dial.

In some conventional locks, a fence lever is pivotally connected near one end of a reciprocative bolt, slidably supported in the lock casing, and provided with a depending nose near the opposite end which is designed to ride upon the drive cam periphery. This lever has a bar or fence projecting laterally in overlying relation with the peripheries of the tumbler wheels. The position of the fence in relation to the length of the fence lever nose is usually such that the fence is spaced slightly from the peripheries of the tumbler wheels when the fence lever nose is riding on the drive cam periphery. The cam includes a gate indented from its perimeter which is adapted to receive the nose which is mechanically connected to the latch mechanism. The tumbler wheels each provide a fence gate located at a proper rotational position of each tumbler wheel. A fence is provided connected to the nose such that the nose cannot enter the cam gate unless the fence is able to enter all fence gates of the tumbler wheels, i.e., the tumbler wheels have all been precisely aligned according to the number combination for the particular lock.

It has been recognized that the fence must be elevated from the tumbler wheels during manipulation of the combination dial to prevent surreptitious "feeling" of the position of the fence gates for the tumbler wheels to ascertain the correct combination numbers. However, in these prior locks, the nose rode on the cam surface which permitted a sensory feel of the fence "drop" while the nose was within the nose gate area of the cam. In other words, when the cam is without support within the cam gate area, the fence dropped to the highest tumbler wheel surface. A skilled person, following a precise procedure can manipulate the dial to determine the position of the fence gates for the tumbler wheels.

Various modifications in combination lock structures have heretofore been resorted to, to defeat detection of the lock combination in this manner. Among these is the lock structure disclosed in prior U.S. Pat. Nos. 2,575,674 and 2,807,954 to Harry C. Miller, wherein a guard or shielding slide is mounted on the rear face of the driving cam and has curved end portions conforming to the curvature of the drive cam periphery which normally overlaps the drive cam gate and forms a smooth continuation of the drive cam periphery to support the fence lever nose when the drive cam gate is in registry with the fence lever nose. An inner spindle extends through the dial spindle and is coupled at its inner end to the shielding slide at its outer end to a knob which is in exposed condition, whereby upon rotation of the knob and inner spindle, the slide may be shifted radially of the drive cam to expose the drive cam gate for reception of the fence lever nose. When the shielding slide is in projected position exposing the drive cam gate to entry of the fence lever nose, stop members on the lock casing are disposed in the path of movement of a portion of the slide to limit rotation of the drive cam to an extent which will prevent detection of contact points for the fence lever nose.

It has been determined, however, that the security of this lock may be adversely effected in time if the portion of the shielding slide which is projected beyond the drive cam periphery becomes worn, as by abrasion against adjacent surfaces of the lock casing. It is possible that the projected end surface of the shielding slide may become worn to a depth equal to the spacing of the fence from the tumbler wheel peripheries when the fence lever nose engages the driving cam periphery. In such a case, the slide may be only partially projected from the position wherein it shields the drive cam gate to lower the fence into contact with the tumbler peripheries and lower the fence lever nose into at least the entrance to the drive cam gate without projecting the slide sufficiently to permit the stop member to limit rotation of the drive cam. In this condition, the dial could be manipulated to permit sensing of the contact points and detection of the combination of the lock.

Combination locks have also been designed to elevate both the nose and the fence from the cam surface and the tumbler wheels respectively during manipulation, while causing a forced descension of the cam nose once each dial rotation to allow engagement between the cam nose and the cam gate if the tumbler wheels are properly aligned. If the tumbler wheels are all aligned properly, the descension of the cam nose into the cam gate is successful and the latch can be mechanically unlatched. Such locks are disclosed in U.S. Pat. Nos. 3,045,466; 4,756,176; and 4,910,981.

However, in accomplishing this task these devices require multiple springs or multiple lever arms and are more costly and complicated than the device offered by the present invention.

SUMMARY OF THE INVENTION

It is an object of the present invention to provide a combination lock which is cost effective in manufacture, rugged in construction, and smooth in operation. It is an object of the present invention to provide a combination lock which prevents the surreptitious obtaining of the correct combination by feeling the position of the fence gates.

An object of the present invention is to provide a novel combination lock having a mechanism which normally maintains the fence lever nose spaced out of contact with the driving cam periphery and which may be operated to shift the fence lever onto momentary engagement with the driving cam only when the driving cam is decoupled from the tumbler wheels to prevent surreptitious detection of the combination of the lock by an unauthorized person.

Another object of the present invention is the provision of a combination lock having a spring start means which normally positions the fence and nose out of contact with the tumbler wheels and driving cam during manipulation of the driving cam to adjust the tumbler wheels to the positions determined by the combination of the lock, to prevent the feel inherent in usual combination locks from assisting an unauthorized person from manipulating the lock, and having an override spring means activated by an eccentric roller to shift the fence lever into coupled relation with the driving cam in a novel manner when the correct combination has been dialed.

Another object of the invention is the provision of a novel combination lock of the above type, wherein a spring activated device is coupled to the fence lever and normally maintains the fence lever in raised position out of contact with the eccentric roller and when stressed by energy from the rotation of the driving cam, in an effective manner after the correct combination has been dialed, to shift the fence lever to unlocking position coupled with the driving cam, if the tumbler wheels are properly aligned.

Another object of the invention is to provide a novel combination lock including novel means to stress the override spring by the reciprocating motion of an eccentric roller and forcing the fence lever toward the drive cam to cause the fence lever to shift to a lowered coupled condition with the driving cam if the tumbler wheels are properly aligned and to cause the driving cam to be spring returned to the raised inactive position if they are not properly aligned.

It is an object of the invention to provide a combination lock assembly which is simple in construction and uses a minimum of moving parts. It is an object of the invention to provide a combination lock construction which is not prone to misalignments or irregular movements. It is an object of the invention to provide a combination lock which has a smooth feel during manipulation and which provides a long useful life.

The objects of the invention are achieved by providing a combination lock having a fence lever with a fence lever nose and a laterally projecting fence arranged above a drive cam periphery and tumbler wheel peripheries respectively, wherein the nose and the fence are normally biased in an elevated position. A means is provided to reverse the bias of the fence lever to urge the fence lever nose and fence downwardly toward the drive cam and tumbler wheels for a portion of the rotary arc of the drive cam, once each revolution. The length of the lever nose is arranged such that the distance between the outer perimeter of the tumbler wheels and the drive cam perimeter radially, is greater than the distance between the bottom surface of the fence and the bottom extent of the nose. Therefore, during rotation of the drive cam through the arc, the fence rides on the tumbler wheels perimeter but the lever nose makes no contact with the cam surface. Therefore, the cam gate contact points cannot be felt to sense the dropping of the fence lever at a particular fence gate. The heretofore known manipulation procedure to surreptitiously obtain the gate positions on the tumbler wheels is not possible.

The objects of the invention are achieved by providing a first coiled wire spring to elevate the cam lever upwardly from the tumbler wheels and cam surface, and an override spring activated by a eccentrically mounted roller on the cam, to overcome the force of the coiled spring and to urge the fence lever, fence and nose downwardly. If the tumbler wheels are correctly aligned, the fence will descend into the fence gates of the tumbler wheels and the nose can proceed downwardly into the nose gate of the cam surface. At this position, the cam is uncoupled form the tumbler wheels and the fence lever is mechanically connected to the latch such that upon further rotation of the cam, by movement of the dial, the latch is retracted to open the safe or other enclosure secured by the lock.

The override spring is inventively configured to wrap around at a pivot point of the fence lever and extend toward the cam and around the eccentric roller. The override spring provides a somewhat J-shape with a inwardly directed detent portion causing an immediate descension of the fence lever at a particular beginning point of the arc.

DETAILED DESCRIPTION OF THE PREFERRED EMBODIMENTS

Figure 1:
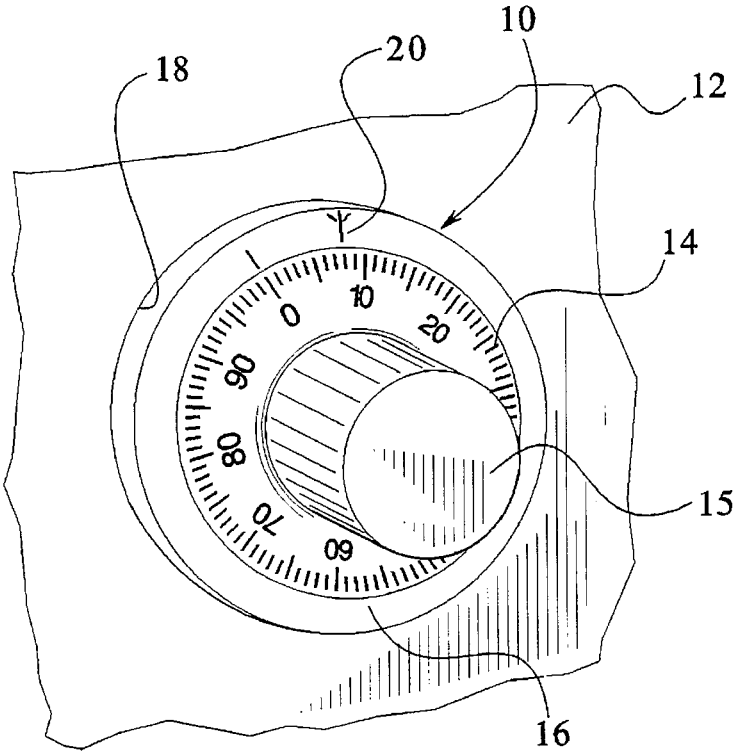
FIG. 1 is a partial perspective view of a front side of the present invention as installed.

FIG. 1 illustrates a lock assembly 10 mounted within and protruding out of an enclosure shown partially as front wall 12, such that a dial 14, knob 15, and flange 16 protrude through a circular hole 18 in the front wall 12. The lock assembly itself is located behind the front wall 12, inaccessible from outside the enclosure. The dial 14 has a plurality of number indicators arranged circumferentially to be aligned with a marker 20 in the manipulation of the knob 15 to input the correct combination of numbers.

Figure 2:
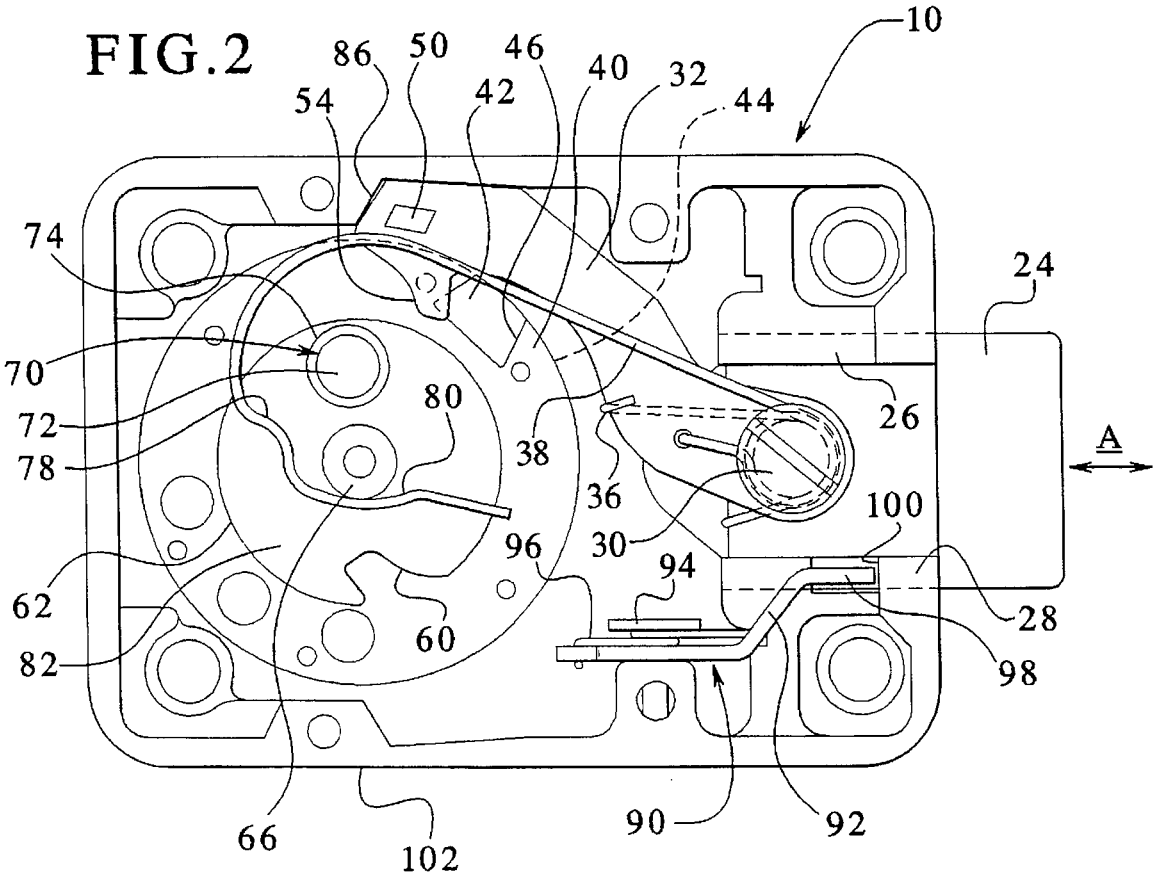
FIG. 2 is a rear view of a lock assembly of the present invention, with a rear cover removed for clarity.

FIG. 2 illustrates a back view of the lock assembly 10 with a back cover removed for clarity. A latch 24 is mounted for reciprocation in the direction A by guide rails 26, 28. A spindle with a slotted head 30 is provided at an inward end of the latch 24. The spindle 30 connects to the latch 24 a fence lever 32 at a base end thereof. Wrapped around the spindle 30 is a return spring 36 and an override spring 38. The return spring 36 and override spring 38 are wire type deformed elements. Connected to the knob 15 and dial 14 is a plurality of tumbler wheels, such as a back tumbler wheel 40, a middle tumbler wheel 42 and a front tumbler wheel 44. The tumbler wheels are arranged coaxially and are turned by a central spindle (not shown) with lost motion as known in the prior art. The back tumbler wheel 40 is connected by a lost motion connection to the knob 15, the intermediate tumbler wheel 42 is connected by a lost motion connection to the back tumbler wheel 40, and the front tumbler wheel 44 is connected by lost motion connection to the intermediate tumbler wheel 42. Each wheel provides a open indent or gate 46, open on its radially outward side. When the gates 46 of the three tumbler wheels are aligned below a fence 50 mounted horizontally and perpendicularly to the lever 32, the fence 50 can proceed downwardly into the gates. To proceed downwardly into the gates, the lever 32 is pivoted counterclockwise about the spindle 30.

Figure 5:
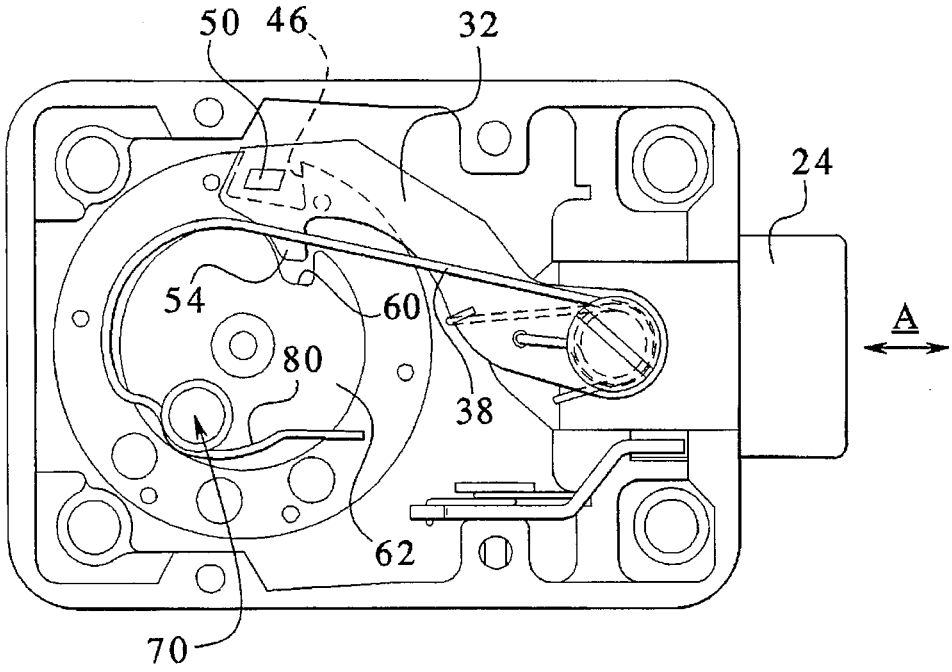
FIG. 5 is a rear view of the lock assembly of FIG. 2 with the cam and tumbler wheels in a delatch position.

When the lever 32 can pivot downwardly with the fence 50 fitting within the gates 46, a lever nose 54 can fit within a cam gate 60 of a cam 62 which is connected to the knob 15 (shown in FIG. 5). A central hub 66 is mounted on a back side of the cam on its axial center line, mounted for rotation with the cam. A roller 70 is mounted eccentrically on the cam for orbiting with cam rotation. For smooth operation, the rollers 70 provide a fixed spindle 72 surrounded by a free rolling rim 74. The override spring 38 extends in a J-shape around the hub 66. The J-shape comprises an inwardly directed detent 78 followed by a valley portion 80. Upon counterclockwise rotation of the cam 62, the roller 70 captures the detent 78 between the free rolling rim 74 and a back surface 82 of the cam 62 to retain the override spring 38 in engagement with the roller 70 during a portion of its orbit. The detent 78 causes an abrupt increase in counterclockwise net bias on the lever 32 upon counterclockwise rotation of the cam, causing a downward movement of the fence 50; and an abrupt reversal of net bias upon clockwise rotation of the cam and engagement of the detent by the roller 70 from the valley portion 80 and a clockwise rotation of the lever 32 and an elevation of the fence 50.

As can be seen when the lever 32 is in its elevated position, movement of the latch 24 inwardly in the direction A is prevented by contact between the lever 32 and a portion 86 of the housing.

As an additional security feature for preventing a forced removal of a back cover of the lock such as by drilling, a spring activated latch lock 90 is provided having a offset lever 92 pivotable about a vertical axis pin 94 and spring loaded toward the latch 24 by a spring 96. The lever 92 provides a horizontal bar portion 98 which is biased toward engagement into a rectangular aperture 100 formed in the latch 24. With the latch in the position shown in FIG. 2, if the back cover is forcibly removed, the lock 90 will pivot to the position wherein the bar portion 98 engages the rectangular aperture 100 to prevent any retraction of the latch 24. With the cover in place, the cover presses against a portion 102 to reverse pivot the lever 92 to retract the bar portion 98 from the aperture 100 to allow the latch to reciprocate, provided that the nose 54 is engaged into the recess 60. U.S. Pat. No. 3,968,667 also illustrates a tamper protection lock device serving the same function as the lever 90 shown in FIG. 2.

FIG. 2 illustrates a condition wherein the correct combination has not been completed and the lever 32 is pivoted clockwise by the spring 36 to elevate the fence 50 and the nose 54 from contact with the tumbler wheels 40, 42, 44 and the cam 62 respectively.

Figure 3:
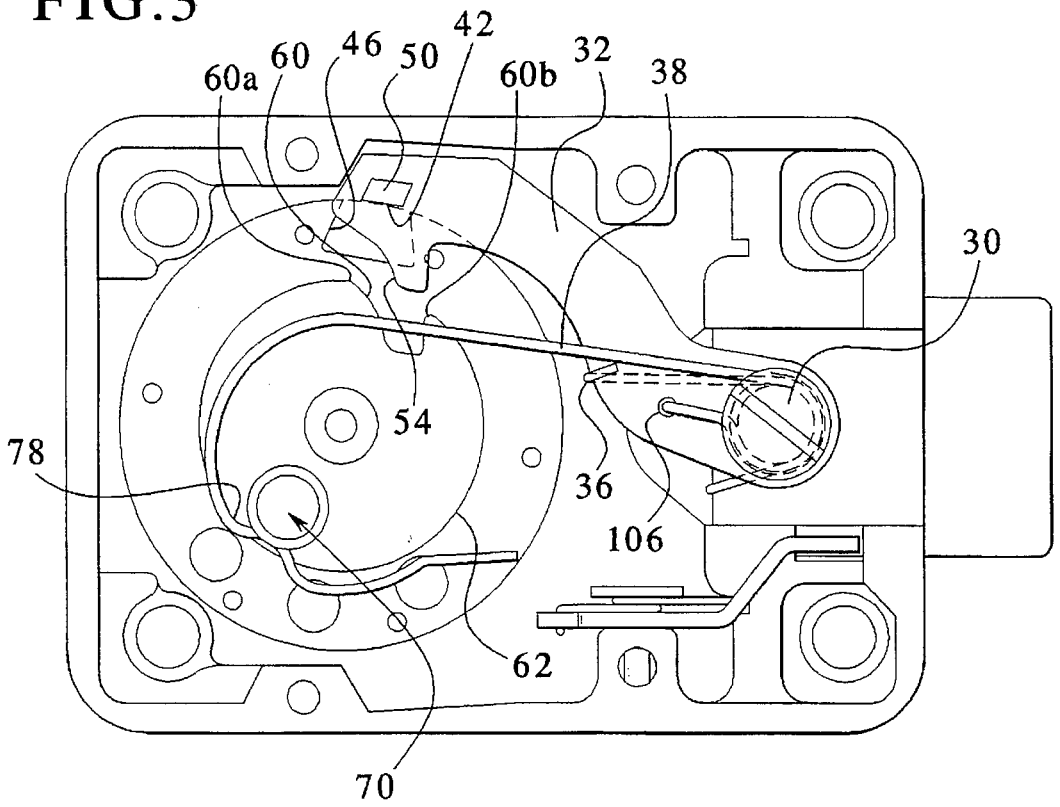
FIG. 3 is a rear view of the lock assembly of FIG. 2 with a cam located in a second position.

FIG. 3 shows the roller 70 in a further orbital position rotated counterclockwise wherein it has captured the override spring 38 at the detent 78 to bend the override spring 38 downwardly which, by virtue of the override spring circling the spindle 30 and engaged into an aperture 106 of the lever 32, urges the lever counterclockwise about the spindle 30. Because in FIG. 3 the proper combination of numbers has not been dialed to align the fence gates 46, at least one tumbler wheel, as illustrated the middle wheel 42, opposes the descension of the fence 50, thus preventing the nose 54 from descending into the gate 60.

Figure 4:
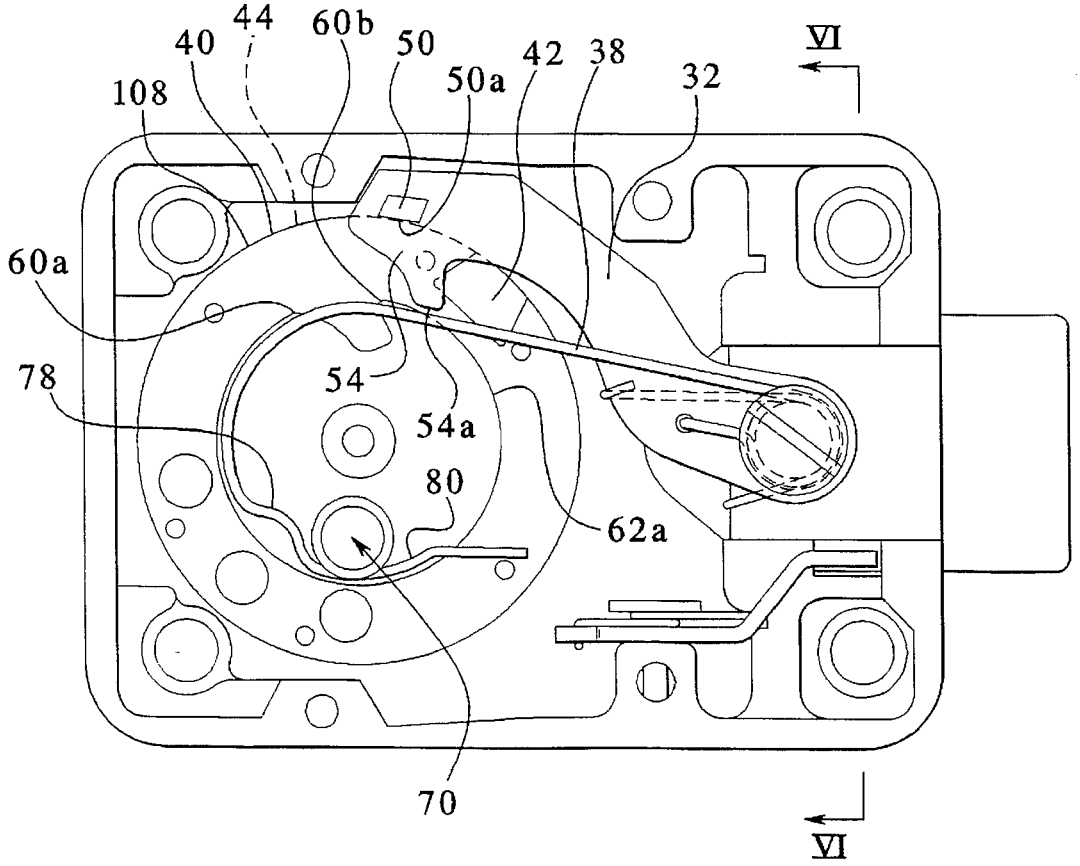
FIG. 4 is a rear view of the lock assembly of FIG. 2 with the cam in a still further position.

FIG. 4 illustrate a further orbital position of the roller 70 which has now passed the detent 78 to roll into the valley 80. An immediate decrease in tension occurs in the override spring, as it is allowed to spring upwardly by a small amount. It however continues to urge the fence lever 32 into a counterclockwise rotation. The fence 50 continues to ride on at least one tumbler wheel 42. Because the distance between a bottom 50*a* of the fence and a bottom 54*a* of the nose 54 is arranged shorter than the distance between an outer perimeter 108 of the wheels 40, 42, 44, the fence will contact the perimeter 108 but the nose 54 will be elevated from the cam surface 62*a* of the cam 62. Thus, a surreptitious feeling of the contact points 60*a*, 60*b* of the gate 60 is not possible.

FIG. 5 shows the cam 62 and the roller 70 in approximately the same position as shown in FIG. 3 except that the tumbler wheels have been correctly aligned, corresponding to a correctly dialed combination of numbers, such that the fence gates 46 are in position to receive the fence 50. The roller 70 has urged the override spring 38 downwardly to create a urging force in a counterclockwise direction on the lever 32 such that the fence 50 descends into the gates 46 and the nose 54 descends into the cam gate 60. Further counterclockwise turning of the cam will cause the cam gate 60 to engage the nose 54 and pull the latch toward the cam 62 in the direction A to unlatch the lock.

Figure 6:
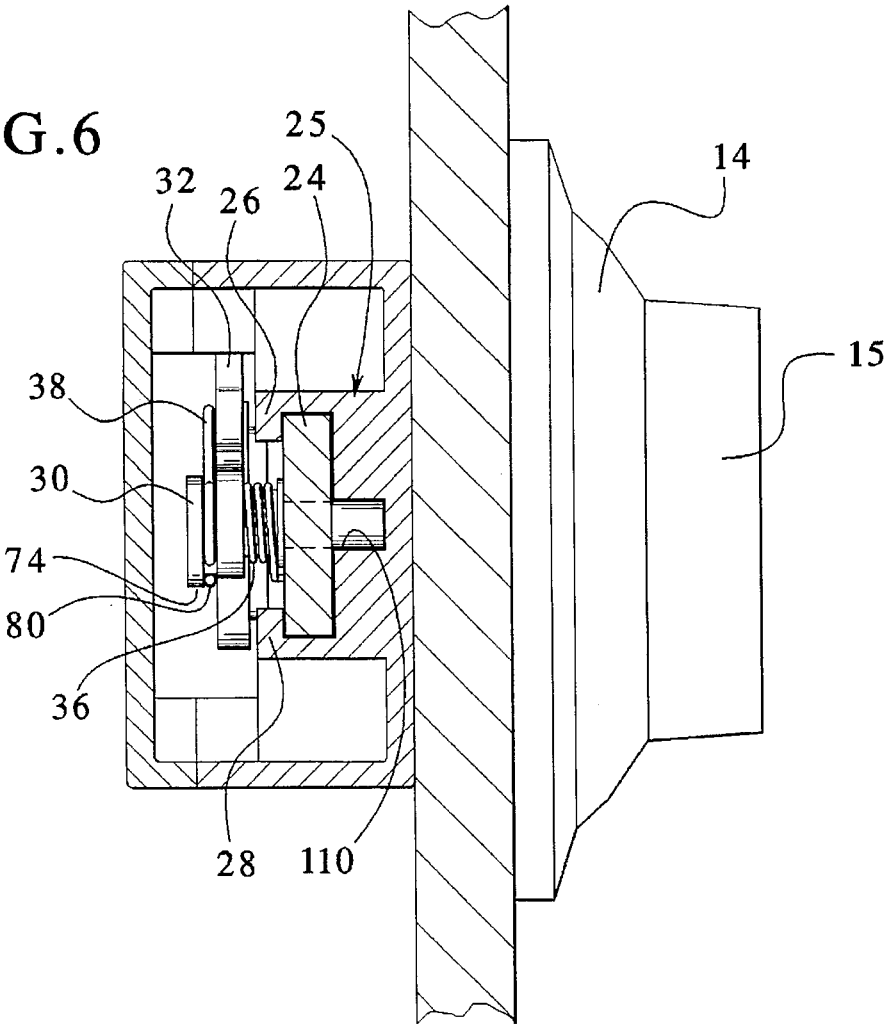
FIG. 6 is a sectional view taken generally along line VI—VI of FIG. 4.

FIG. 6 illustrates that the override spring 38 is wrapped once around the spindle 30, and the return spring 36 is wrapped around a lower portion of the spindle 30. The spindle 30 penetrates the latch 24 and also moves in the direction A through a slot 110 formed in the housing 25.

Although the present invention has been described with reference to a specific embodiment, those of skill in the art will recognize that changes may be made thereto without departing from the scope and spirit of the invention as set forth in the appended claims.

I claim as my invention:

1. A combination lock comprising:

a plurality of tumbler wheels, each having a fence gate formed into an outer perimeter thereof, said tumbler wheels arranged coaxially in stacked arrangement;

a driving cam arranged coaxially with said tumbler wheels, said driving cam having a cam gate formed in a perimeter thereof;

a latch reciprocally mounted in said housing to protrude outwardly thereof;

a fence lever pivotally mounted to said latch at a base end thereof and extending to a distal end approximate said perimeter of said tumbler wheels;

a fence connected to said fence lever and extending laterally thereof;

a dial means for selectively aligning said fence gates of said tumbler wheels below said fence;

a fence lever nose extending toward said driving cam and engageable to said cam gate when said fence is inserted into said fence gates;

a first spring arranged between said fence lever and a stationary portion of said lock assembly for biasing said nose and said fence to an elevated position above said driving cam and said tumbler wheels respectively;

said cam providing a roller extending rearwardly therefrom to orbit upon rotation of said cam; and a second spring carried by said fence lever and arranged extending from said fence lever to said cam and engageable by said roller to resiliently urge said second spring downwardly to urge said nose and said fence downwardly during an arc portion of each full rotation of said dial means.

2. The combination lock according to claim 1, wherein said roller comprises a fixed spindle surrounded by a rolling rim, wherein said second spring is partially captured between said rolling rim and a back surface of said cam.

3. The combination lock according to claim 1 wherein a first distance taken between an outside radial surface of said tumbler wheels and an outside radial surface of said cam is greater than a second distance taken between a bottom surface of said fence and a bottom surface of said nose.

4. A combination lock comprising:

a plurality of tumbler wheels, each having a fence gate formed into an outer perimeter thereof, said tumbler wheels arranged coaxially in stacked arrangement;

a driving cam arranged coaxially with said tumbler wheels, said driving cam having a cam gate formed in a perimeter thereof;

a latch reciprocally mounted in said housing to protrude outwardly thereof;

a fence lever pivotally mounted to said latch at a base end thereof and extending to a distal end approximate said perimeter of said tumbler wheels;

a fence connected to said fence lever and extending laterally thereof;

a dial means for selectively aligning said fence gates of said tumbler wheels below said fence;

a fence lever nose extending toward said driving cam and engageable to said cam gate when said fence is inserted into said fence gates;

a first spring arranged between said fence lever and a stationary portion of said lock assembly for biasing said nose and said fence to an elevated position above said driving cam and said tumbler wheels respectively;

said cam providing a roller extending rearwardly therefrom to orbit upon rotation of said cam; and a second spring arranged extending from said fence lever to said cam and engageable by said roller to resiliently urge said second spring downwardly to urge said nose and said fence downwardly during an arc portion of each full rotation of said dial means;

wherein said second spring comprises a J-shaped wire spring, and said fence lever is pivotally attached to said latch and said J-shaped wire spring is wrapped around said pivotal connection and extends around said roller.

5. The combination lock according to claim 4, wherein said J-shaped spring comprises a detent engageable by said roller for downwardly depressing said fence during rotation of said cam.

6. The combination lock according to claim 4, wherein said J-shaped wire spring is anchored into a hole extending into a back surface of said fence lever.

7. A combination lock comprising:

a housing;

a plurality of tumbler wheels, each having a fence gate formed into an outer perimeter thereof, said tumbler wheels arranged coaxially in stacked arrangement, said tumbler wheels arranged inside said housing;

a driving cam arranged coaxially with said tumbler wheels;

a fence lever pivotably and slidably mounted within said housing at a base end thereof, and extending to a distal end approximate said perimeter of said tumbler wheels;

a fence connected to said fence lever and extending laterally thereof above said perimeter of said tumbler wheels;

a dial means for selectively aligning said fence gates of said tumbler wheels below said fence upon correct dialing of a combination of numbers;

a cam engaging means for engaging said driving cam when said fence is inserted into said fence gates;

a means for biasing said fence lever in a rotary direction to elevate said fence above said perimeter of said tumbler wheels;

a roller mounted eccentrically to said driving cam;

an override spring arranged extending from said fence lever to said cam said override spring connected to said fence lever to slide therewith, and said override spring engageable by said eccentric roller to resiliently urge said override spring downwardly to urge said fence lever in a rotary direction to urge said fence downwardly during an arc portion of each full rotation of said dial means;

a latch means for causing a locking of said combination lock to an adjacent structure, said latch operably connected to said fence lever for unlatching upon sliding movement of said fence lever.

8. The combination lock according to claim 7, wherein said cam engaging means comprising a cam gate formed into a perimeter of said driving cam and a lever nose extending from said fence lever for interfittment into said cam gate.

9. The combination lock according to claim 7, wherein said means for biasing comprises a lever spring arranged between said fence lever and a stationary portion of said lock assembly.

10. The combination lock according to claim 7, wherein said latch means comprises a latch reciprocally mounted in said housing and extending outwardly thereof.

11. The combination lock according to claim 7, wherein said roller comprises a fixed spindle surrounded by a rolling rim, wherein said override spring is partially captured between said rolling rim and a back surface of said cam.

12. The combination lock according to claim 7, wherein a first distance taken between an outside radial surface of said tumbler wheels and an outside radial surface of said cam is greater than a second distance taken between a bottom surface of said fence and a bottom surface of said cam engaging means.

13. A combination lock comprising:

a housing;

a plurality of tumbler wheels, each having a fence gate formed into an outer perimeter thereof, said tumbler wheels arranged coaxially in stacked arrangement, said tumbler wheels arranged inside said housing;

a driving cam arranged coaxially with said tumbler wheels;

a fence lever pivotably and slidably mounted within said housing at a base end thereof, and extending to a distal end approximate said perimeter of said tumbler wheels;

a fence connected to said fence lever and extending laterally thereof above said perimeter of said tumbler wheels;

a dial means for selectively aligning said fence gates of said tumbler wheels below said fence upon correct dialing of a combination of numbers;

a cam engaging means for engaging said driving cam when said fence is inserted into said fence gates;

a means for biasing said fence lever in a rotary direction to elevate said fence above said perimeter of said tumbler wheels;

a roller mounted eccentrically to said driving cam;

an override spring arranged extending from said fence lever to said cam and engageable by said eccentric roller to resiliently urge said override spring downwardly to urge said fence lever in a rotary direction to urge said fence downwardly during an arc portion of each full rotation of said dial means;

a latch means for causing a locking of said combination lock to an adjacent structure, said latch operably connected to said fence lever for unlatching upon sliding movement of said fence lever;

wherein said override spring comprises a J-shaped wire spring, and said fence, lever is pivotally attached to said latch and said J-shaped wire spring is wrapped around said pivotal connection and extends around said roller.

14. The combination lock according to claim 13, wherein said J-shaped spring comprises a detent engageable by said roller for downwardly depressing said fence during rotation of said cam.

15. A combination lock comprising:

a housing;

a plurality of tumbler wheels, each having a fence gate formed into an outer perimeter thereof, said tumbler wheels arranged coaxially in stacked arrangement, said tumbler wheels arranged inside said housing;

a driving cam arranged coaxially with said tumbler wheels;

a fence lever pivotably and slidably mounted within said housing at a base end thereof, and extending to a distal end approximate said perimeter of said tumbler wheels;

a fence connected to said fence lever and extending laterally thereof above said perimeter of said tumbler wheels;

a dial means for selectively aligning said fence gates of, said tumbler wheels below said fence upon correct dialing of a combination of numbers;

a cam engaging means for engaging said driving cam when said fence is inserted into said fence gates;

a means for biasing said fence lever in a rotary direction to elevate said fence above said perimeter of said tumbler wheels;

a roller mounted eccentrically to said driving cam;

an override spring arranged extending from said fence lever to said cam and engageable by said eccentric roller to resiliently urge said override spring downwardly to urge said fence lever in a rotary direction to urge said fence downwardly during an arc portion of each full rotation of said dial means;

a latch means for causing a locking of said combination lock to an adjacent structure, said latch operably connected to said fence lever for unlatching upon sliding movement of said fence lever;

wherein said cam engaging means comprising a cam gate formed into a perimeter of said driving cam and a lever nose extending from said fence lever for interfittment into said cam gate;

wherein solid said override spring comprises a J-shaped wire spring and said J-shaped wire spring is anchored into a hole extending into a back surface of said fence lever.

16. In a combination lock having a housing and a plurality of tumbler wheels within said housing, each having a fence gate formed into an outer perimeter thereof, said tumbler wheels arranged coaxially in stacked arrangement; a driving cam arranged coaxially with said tumbler wheels, said driving cam having a cam gate formed in a perimeter thereof; a latch reciprocally mounted in said housing to protrude outwardly thereof; a fence lever pivotally mounted at a pivot connection to said latch at a base end thereof and extending to a distal end approximate said perimeter of said tumbler wheels; a fence connected to said fence lever and extending laterally thereof; a dial means for selectively aligning said fence gates of said tumbler wheels below said fence; a fence lever nose extending toward said driving cam and engageable to said cam gate when said fence is inserted into said fence gates; a first spring arranged between said fence lever and a stationary portion of said lock assembly for biasing said nose and said fence to an elevated position above said drive cam and said tumbler wheels respectively, the improvement comprising:

said cam providing a roller extending rearwardly therefrom to orbit upon rotation of said cam; and a second spring arranged extending from said base end of said fence lever to said cam and engageable by said roller to resiliently urge said second spring downwardly to urge said nose and said fence downwardly during a arc portion of each full rotation of said dial means.

17. The improvement according to claim 16, wherein said roller comprises a fixed spindle surrounded by a rolling rim, wherein said second spring is partially captured between said rolling rim and a back surface of said cam.

18. The improvement according to claim 16, wherein a first distance taken between an outside radial surface of said tumbler wheels and an outside radial surface of said cam is greater than a second distance taken between a bottom surface of said fence and a bottom surface of said nose.

19. In a combination lock having a housing and a plurality of tumbler wheels within said housing, each having a fence gate formed into an outer perimeter thereof, said tumbler wheels arranged coaxially in stacked arrangement; a driving cam arranged coaxially with said tumbler wheels, said driving cam having a cam gate formed in a perimeter thereof; a latch reciprocally mounted in said housing to protrude outwardly thereof; a fence lever pivotally mounted at a pivot connection to said latch at a base end thereof and extending to a distal end approximate said perimeter of said tumbler wheels; a fence connected to said fence lever and extending laterally thereof; a dial means for selectively aligning said fence gates of said tumbler wheels below said fence; a fence lever nose extending toward said driving cam and engageable to said cam gate when said fence is inserted into said fence gates; a first spring arranged between said fence lever and a stationary portion of said lock assembly for biasing said nose and said fence to an elevated position above said drive cam and said tumbler wheels respectively, the improvement comprising:

said cam providing a roller extending rearwardly therefrom to orbit upon rotation of said cam; and a second spring arranged extending from said fence lever to said cam and engageable by said roller to resiliently urge said second spring downwardly to urge said nose and said fence downwardly during a arc portion of each full rotation of said dial means;

wherein said second spring comprises a J-shaped wire spring, and said fence lever is pivotally attached to said latch and said J-shaped wire spring is wrapped around said pivotal connection and extends around said roller.

20. The improvement according to claim 19, wherein said J-shaped spring comprises a detent engageable by said roller for downwardly depressing said fence during rotation of said cam.

21. The improvement according to claim 19, wherein said J-shaped wire spring is anchored into a hole extending into a back surface of said fence lever.

* * * * *